US006527035B2

(12) United States Patent
Hoofard et al.

(10) Patent No.: US 6,527,035 B2
(45) Date of Patent: Mar. 4, 2003

(54) GUIDE TRACK ASSEMBLIES AND MOUNTING BRACKETS FOR UPWARD ACTING DOORS

(75) Inventors: Richard K. Hoofard, Dallas, TX (US); Celestino Duran, Lewisville, TX (US); David M. Wells, Arlington, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/866,635

(22) Filed: May 30, 2001

(65) Prior Publication Data

US 2002/0003031 A1 Jan. 10, 2002

Related U.S. Application Data

(63) Continuation-in-part of application No. 09/610,806, filed on Jul. 6, 2000.

(51) Int. Cl.[7] ..... E05D 15/06

(52) U.S. Cl. ..... 160/201; 160/188; 160/189; 160/209; 49/199

(58) Field of Search ..... 160/188, 189, 160/201, 209; 49/199, 200; 248/224.8, 225.11, 225.21; 403/348, 353

(56) References Cited

U.S. PATENT DOCUMENTS

| | | | | | |
|---|---|---|---|---|---|
| 2,271,309 | A | | 1/1942 | Rowe | |
| 2,327,778 | A | | 8/1943 | Ferris et al. | |
| 2,630,597 | A | | 3/1953 | Robinson | |
| 2,827,114 | A | | 3/1958 | Stroup | |
| 3,662,874 | A | | 5/1972 | Muller | |
| 3,693,693 | A | | 9/1972 | Court | |
| 3,848,920 | A | | 11/1974 | Linhart et al. | |
| 4,257,155 | A | * | 3/1981 | Hunter | 29/511 |
| 4,483,045 | A | | 11/1984 | Shelton et al. | |
| 4,690,359 | A | * | 9/1987 | Phillips | 248/300 |
| 4,725,029 | A | * | 2/1988 | Herve | 248/223.1 |
| 4,769,897 | A | * | 9/1988 | Moseman | 29/525 |
| 4,930,563 | A | | 6/1990 | Finch et al. | |
| 5,036,899 | A | | 8/1991 | Mullet | |
| D337,042 | S | | 7/1993 | Lin et al. | |
| 5,240,216 | A | | 8/1993 | Lin et al. | |
| 5,409,051 | A | | 4/1995 | Mullet et al. | |
| 5,429,170 | A | | 7/1995 | Nogaki | |
| 5,429,412 | A | * | 7/1995 | Schoen et al. | 296/187 |
| 5,568,672 | A | | 10/1996 | Mullet et al. | |
| 5,636,678 | A | | 6/1997 | Carper et al. | |
| 5,718,533 | A | | 2/1998 | Mullet et al. | |
| 5,865,235 | A | | 2/1999 | Krupke et al. | |
| 5,954,111 | A | | 9/1999 | Ochoa | |
| 5,964,268 | A | | 10/1999 | Carper et al. | |
| 6,047,761 | A | | 4/2000 | Jaehnen et al. | |
| 6,094,779 | A | | 8/2000 | Young | |
| 6,125,582 | A | | 10/2000 | Mondragon et al. | |
| 6,134,835 | A | | 10/2000 | Krupke et al. | |
| 6,173,532 | B1 | * | 1/2001 | Beausoleil | 49/199 |
| 6,217,248 | B1 | * | 4/2001 | Reiff | 403/24 |
| 6,250,360 | B1 | * | 6/2001 | Ochoa | 160/201 |
| 6,253,824 | B1 | * | 7/2001 | Mullet et al. | 160/188 |

* cited by examiner

*Primary Examiner*—Bruce A. Lev
(74) *Attorney, Agent, or Firm*—Gardere Wynne Sewell LLP

(57) ABSTRACT

Guide track assemblies for upward acting doors include identical vertical and horizontal linear track sections and a curvilinear transition track section. The linear track sections include spaced-apart elongated slots formed at acute angles with respect to the longitudinal extent of the track sections for cooperation with retainer members mounted on angle-shaped jamb brackets. A header bracket also includes one or more retainer members thereon for disposition in similar elongated slots formed in the curvilinear track section. The linear track sections fit in telescoping relationship within enlarged end portions of the curvilinear track section. The configurations of the header brackets, jamb brackets and track sections facilitate quick assembly and easy positional adjustment of the track sections with respect to a door opening covered by a door guided by the track assemblies.

21 Claims, 6 Drawing Sheets

GUIDE TRACK ASSEMBLIES AND MOUNTING BRACKETS FOR UPWARD ACTING DOORS

CROSS REFERENCE TO RELATED APPLICATION

This application is a continuation in part of U.S. patent application Ser. No. 09/610,806 filed Jul. 6, 2000.

BACKGROUND OF THE INVENTION

In the art of upward acting single and multi-panel garage doors and the like, there has been a continuing need to develop door guide track assemblies which are economical to manufacture, easy to install, and can accommodate door installations where low headroom or low ceiling height conditions are encountered. In particular, there has also been a continuing need to develop simplified guide track assemblies which reduce manufacturing costs and the number of different parts required to be carried in inventory by door dealers and installers. Still further, there has been a continuing need to provide door guide track assemblies wherein the guide track members and associated mounting brackets are adapted for ease of installation and wherein the track assemblies may be prepositioned with their cooperating parts connected to each other and then adjusted for final securement to each other. These desiderata together with the ever present need to reduce costs associated with the manufacture and installation of door guide track assemblies have been substantially met by the present invention.

BRIEF SUMMARY OF THE INVENTION

The present invention provides improved guide track assemblies and mounting brackets therefor for use with upward acting garage doors and the like.

In accordance with one aspect of the invention, improved guide track assemblies are provided which include three part tracks which make up the entire track length, including a vertical track section, a curved transition track section and a substantially horizontally extending track section. The transition track section may be of a circular radius of curvature or, for low headroom applications, the transition section is preferably formed with generally elliptical radius of curvature or a similar geometry. The elliptical curvature is preferably provided with major and minor axes having a length ratio of about 1.5:1 to 2:1.

In accordance with another aspect of the present invention, the track assemblies include improved mounting brackets for supporting the vertically extending track sections and the transition track sections. The respective mounting brackets are provided with connector or retainer elements which are easily and adjustably connected to the respective track sections. In particular, the mounting brackets are preferably provided with one or more rivet head shaped retainer members mounted thereon and operable to be engaged with a track section at cooperating keyhole-shaped slots. Mounting brackets are also provided with portions which engage the track section to provide a snug fit between the brackets and the track section so that the brackets do not slip out of position during installation procedures.

In accordance with still a further aspect of the invention, a guide track assembly in accordance with the invention is provided with generally straight track sections which are interchangeable between left and right-hand assemblies (opposite sides of the door) and between the vertically and horizontally extending parts of the guide track assemblies. The so-called straight track sections are also adapted to be connected to track mounting brackets in such a way that the retainer portions of the mounting brackets, once the brackets are secured to the door jamb or the wall adjacent the door opening, support the track sections stationary without requiring separate fasteners interconnecting the brackets with the tracks. Still further, mounting brackets are provided which are adapted to be connected to the guide track transition section to accommodate selective positioning of the track assemblies with respect to a wall to which the mounting brackets are attached and also to eliminate the requirement for separate, generally horizontally extending bracket parts for supporting a track assembly.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENT

Figure 1:
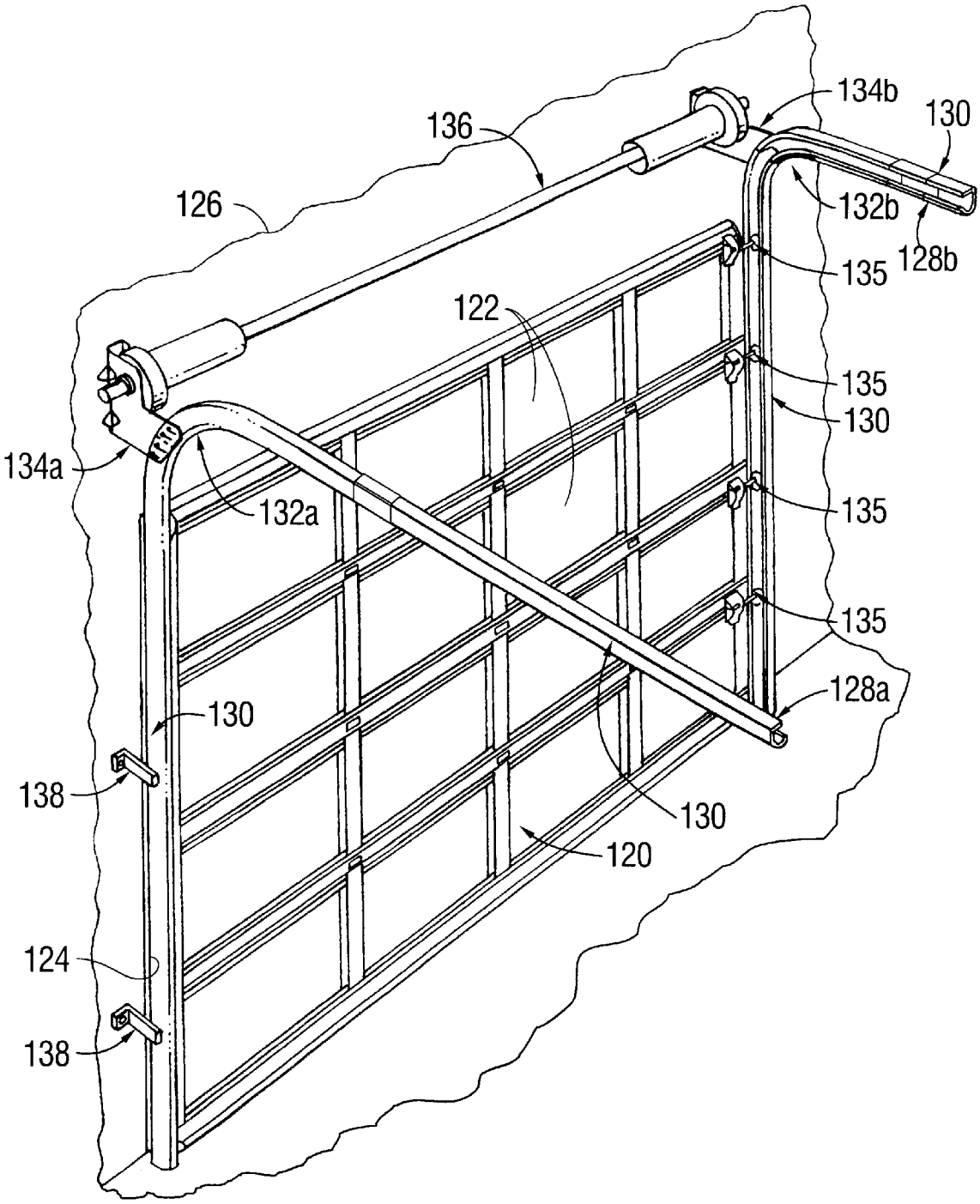
FIG. 1 is a perspective view of a sectional upward acting door including the guide track assemblies of the present invention.

In the description which follows, like parts are marked throughout the specification and drawing with the same reference numerals, respectively. The drawing figures are not necessarily to scale and certain features may be shown in somewhat schematic or generalized form in the interest of clarity and conciseness.

Referring to FIG. 1, there is illustrated a sectional upward acting door 120 comprising plural hingedly interconnected panels 122 adapted to form a closure over an opening 124 in a vertical wall 126. The door 120 is guided for movement between the closed position shown and an open position by opposed guide track assemblies 128*a* and 128*b* which are substantially identical but of the opposite hand or otherwise identified as left-hand and right-hand assemblies. For the further discussion herein, a detailed description of the guide track assembly 128*a* will be provided. Those skilled in the art will appreciate that the guide track assembly 128*b* is substantially identical to the assembly 128*a* but is a mirror image thereof. Moreover, common parts are used to provide the guide track assemblies 128*a* and 128*b*. For example, the guide track assembly 128*a* is characterized by a vertically extending track section 130 and a second horizontally extending track section which is identical to the vertically extending track section and is also designated by the numeral 130. A curvilinear transition section 132*a* is interposed the vertical section 130 and the horizontal section 130 and is connected to a header bracket 134*a*. Header bracket 134*a* is cooperable with an opposed header bracket 134*b* to support a counterbalance mechanism, generally designated by the numeral 136. The mechanism 136 may be of a type such as described in U.S. Pat. No. 6,134,835 issued Oct. 24, 2000 to LeRoy G. Krupke et al and assigned to the assignee of the present invention.

Guide track assembly 128*b* is substantially like guide track assembly 128*a* and is characterized by a vertically extending track section 130, a horizontally extending track section 130 and a curved transition section 132*b* interposed the straight track sections and connected thereto in a manner to be described in further detail herein. Transition track section 132*b* is supported by header bracket 134*b* in the same manner that transition section 132*a* is supported by header bracket 134*a*.

Each of the door panels 122 is preferably guided for movement between open and closed positions of the door 120 by suitable roller guide members 135 of a type known to those skilled in the art and adapted to roll along and within the guide track sections 130, 132*a* and 132*b* of the respective track assemblies 128*a* and 128*b*. Moreover, the vertically extending track sections 130 of the respective track assemblies 128*a* and 128*b* are supported at the wall 126 by spaced-apart jamb brackets 138, two shown for supporting the track assembly 128*a* in FIGS. 1 and 2. The horizontally extending track sections 130 are preferably supported by brackets, not shown, depending from a ceiling or other structure, not shown, in a conventional manner.

Figure 2:
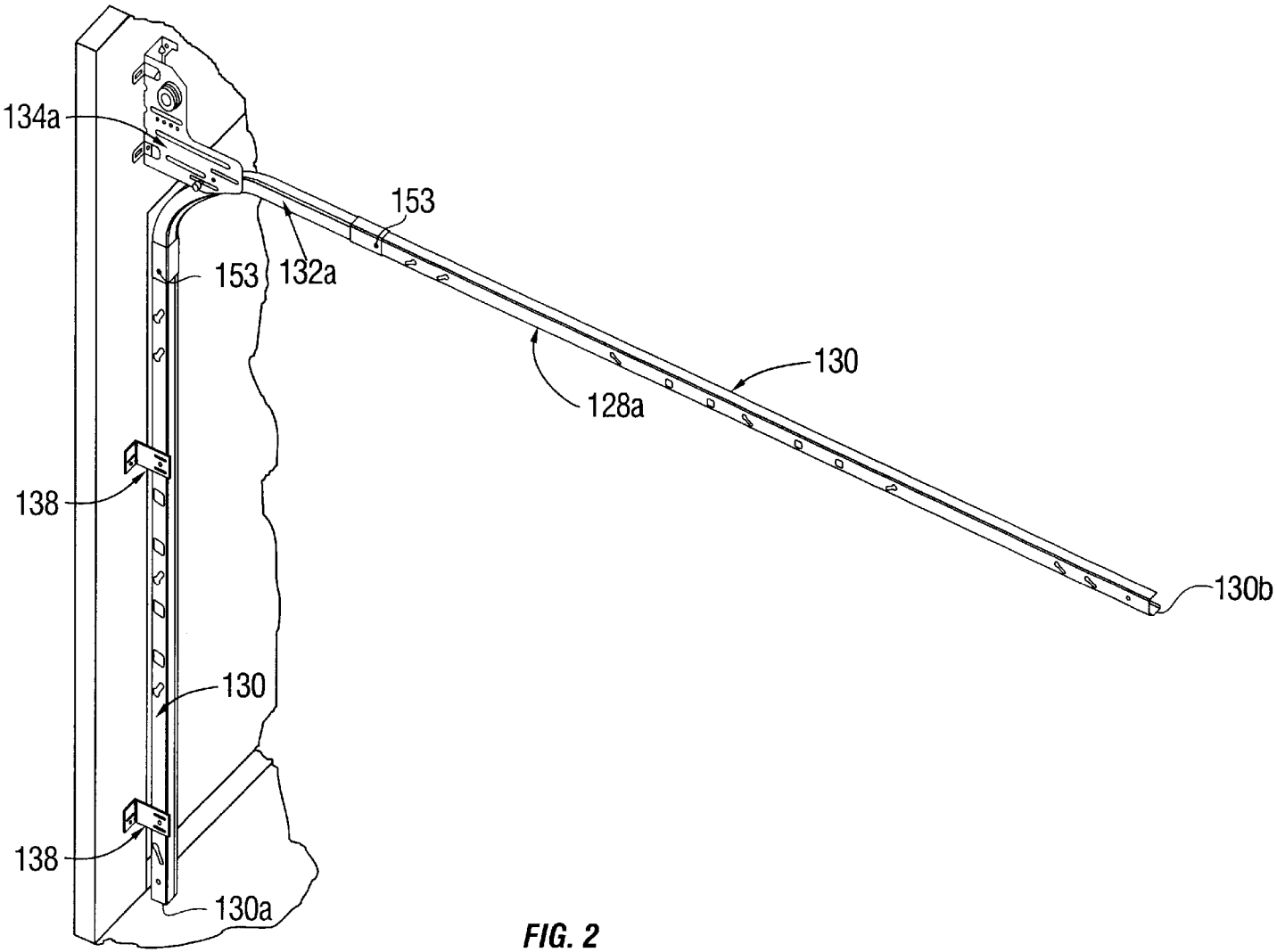
FIG. 2 is a perspective view of the left-hand guide track assembly for the door shown in FIG. 1.
Figure 3:
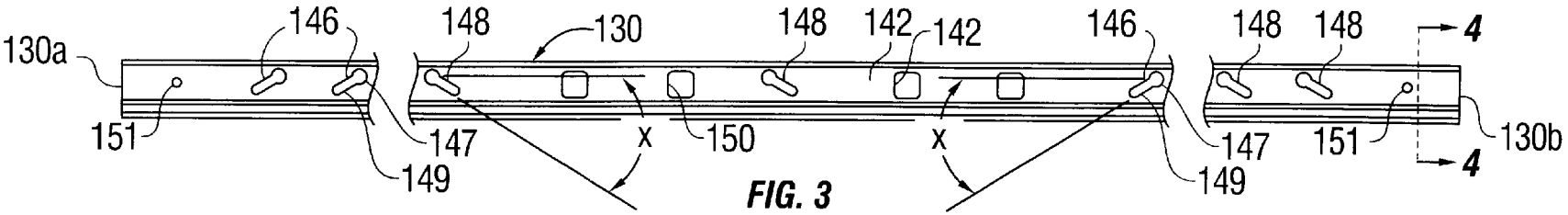
FIG. 3 is a longitudinal side elevation of one of the straight track sections for the guide track assemblies shown in FIGS. 1 and 2.
Figure 4:
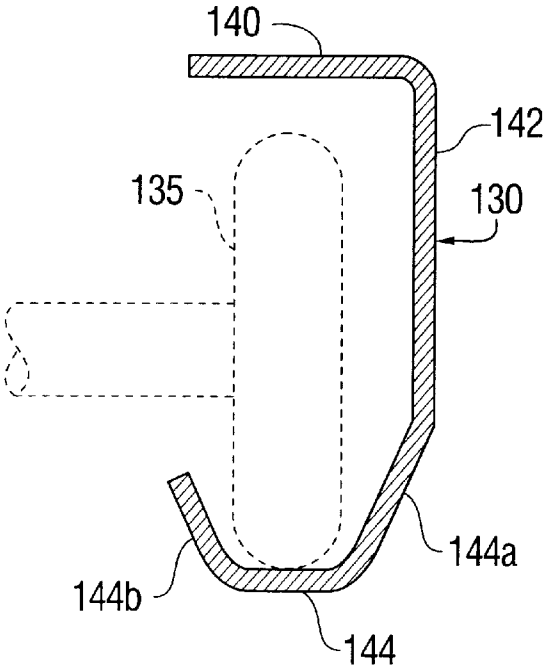
FIG. 4 is a section view taken along the line 4—4 of FIG. 3.

Referring now to FIGS. 2, 3 and 4, each of the straight track sections 130 comprises an elongated rolled or otherwise formed metal member including, as shown in FIGS. 3 and 4, a flange 140, a web 142 extending at right angles to the flange and a channel-shaped portion 144 having angled side walls 144*a* and 144*b* for receiving a guide roller member 135. As shown in FIG. 3, the web 142 is provided with plural spaced-apart somewhat keyhole-shaped slots 146 and 148. Each of the slots 146 includes an enlarged generally circular opening 147 contiguous with a narrow elongated slot part 149. The slot parts 149 extend at an acute angle X with respect to the longitudinal extent of the track section 130, as shown in FIG. 3. The slots 148 have the same geometry as the slots 146 but extend at an acute angle X in opposite directions, as indicated in FIG. 3. Accordingly, a pair of slots 146 is disposed adjacent one end 130*a* of a track section 130 and a pair of slots 148 is disposed adjacent an opposite end 130*b* of a track section 130, as shown in FIG. 3. Respective slots 146 and 148 are disposed spaced substantially apart from each other between the aforementioned pairs of slots 146 and 148 and a single slot 148 is disposed intermediate the single opposed slots 146 and 148 just described and as shown in FIG. 3. Spaced-apart door latch-bar receiving openings 150 may be provided in the web 142 also, as shown in FIG. 3. Moreover, the pattern of the slots 146 and 148 and the openings 50 are such as to allow the track sections 130 to be used in both left-hand and right-hand applications and in both horizontal and vertical applications as will be appreciated by those skilled in the art. Still further, each of the track sections 130 is provided with a fastener receiving hole 151, FIG. 3, preferably located adjacent each of the respective ends 130*a* and 130*b*.

By providing opposed pairs of slots 146 and 148 adjacent opposite ends of the track section 130 and by providing intermediate spaced-apart slots 146 and 148, as shown in FIG. 3, a track section 130 may be connected to a wall, such as the wall 126, at a selected position in accordance with a structural member available for securing the track section to the wall via a bracket 138. Moreover, for door installations requiring extra reinforcement to accommodate high wind loads, for example, additional brackets 138 may be connected to a track section 130 and to the wall adjacent the door opening to reinforce the door assembly. By positioning respective pairs of angled slots 146 and 148 adjacent opposite ends of a track section 130, the track section may be used in both left-hand and right-hand track assemblies, as well as in both vertical and horizontal positions, as shown by way of example in FIGS. 1 and 2.

Still further, by positioning fastener receiving openings or holes 151 at opposite ends of a track section 130, the track section may be secured to a curvilinear track section 132*a* or 132*b*, as required, to form a track assembly. For example, as shown in FIG. 2, a horizontal track section 130 is secured to the curvilinear track section 132*a* by an arrangement which includes a fastener assembly 153 comprising a conventional panhead or flathead machine screw and nut assembly, for example, for positively securing the straight or linear track section 130 to the curvilinear track section 132*a*. In like manner, the track section 130 extending vertically along the wall 126 may also be secured to the opposite end of the curvilinear track section 132*a* by a second fastener assembly 153.

Figure 5:
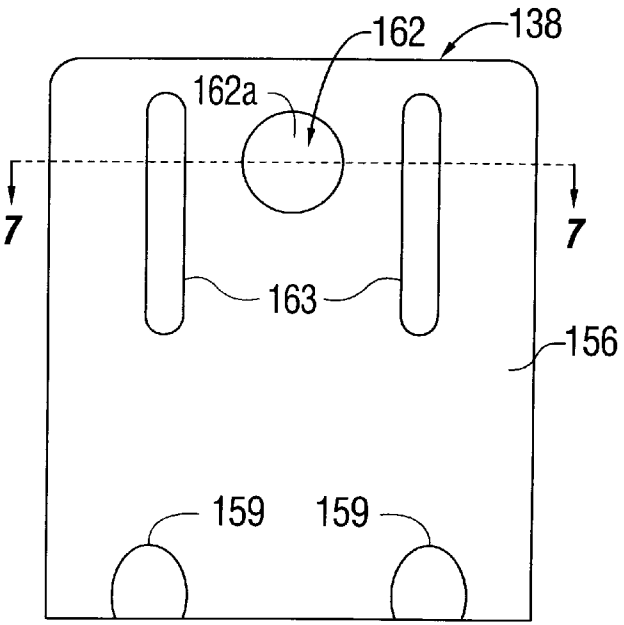
FIG. 5 is a side elevation of one of the mounting brackets for the track assemblies of the present invention.
Figure 6:
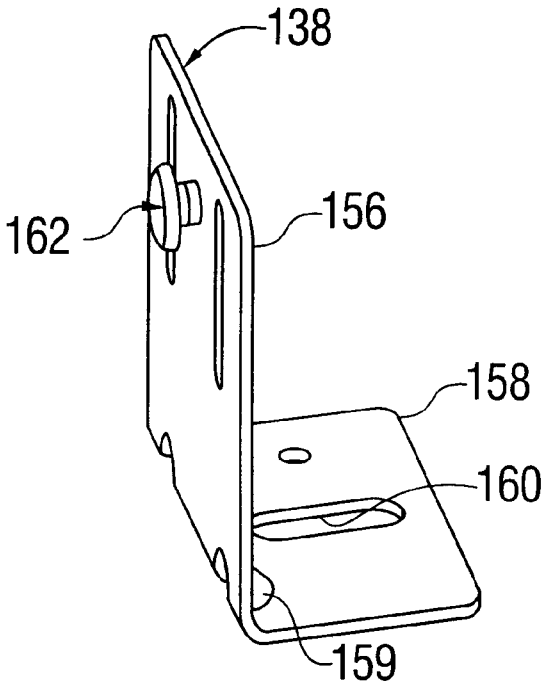
FIG. 6 is a perspective view of the bracket shown in FIG. 5.
Figure 7:
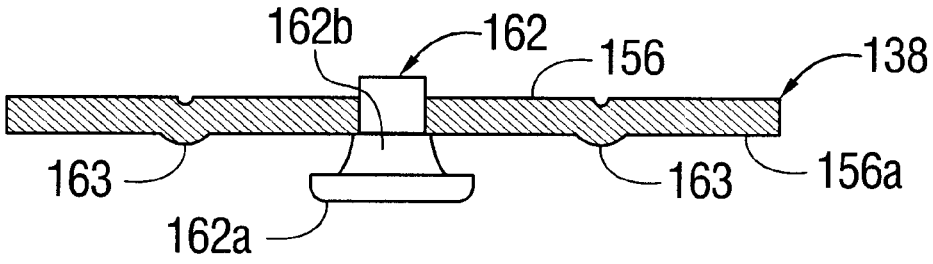
FIG. 7 is a section view taken along the line 7—7 of FIG. 5.

Referring now to FIGS. 5, 6 and 7, the jamb bracket 138 preferably comprises a formed metal member, including a first flange 156 and a second flange 158 integrally joined to the first flange, see FIG. 6, and extending at right angles thereto. Coined or otherwise formed reinforcing gussets 159 are provided between the flanges 156 and 158. The flange 158 includes an elongated fastener receiving slot 160 formed therein and flange 156 includes a somewhat rivet-shaped retainer member 162 mounted thereon and interposed elongated parallel extending raised bosses 163. As shown in FIG. 7, bosses 163 project from the surface 156*a* of the flange 156 in the same direction as the retainer member 162, including an enlarged diameter head portion 162*a*. Retainer member 162 also includes a reduced diameter shank portion 162*b*, a part of which projects through a suitable opening in the flange 156 and may be deformed in a known manner to secure the retainer member 162 firmly to the bracket 138. The distance between the flange 162*a* and the bosses 163 is determined to be essentially the same as or slightly less than the thickness of the web 42 of each track section 130. When a bracket 138 is connected to a track section 130, the retainer head 162*a* is inserted into a slot 146 or 148 through the large diameter opening portion, such as portion 147, and the bracket is then moved to a position such that the retainer 162 is disposed in the slot portion 149, for example, and the bracket is firmly but slidably engaged with the web 42 on opposite sides thereof by the bosses 163 and the retainer head 162*a*. In this way, the brackets 138 may be prepositioned on and supported by track section 130 and remain in their designated positions during a track mounting or installation procedure. However, the brackets 138 may also be conveniently moved within the slots 146 and/or 148 and with respect to a track section 130, as needed, to adjust the final position of a track assembly, such as the track assembly 128*a,* with respect to wall 126.

Figure 8:
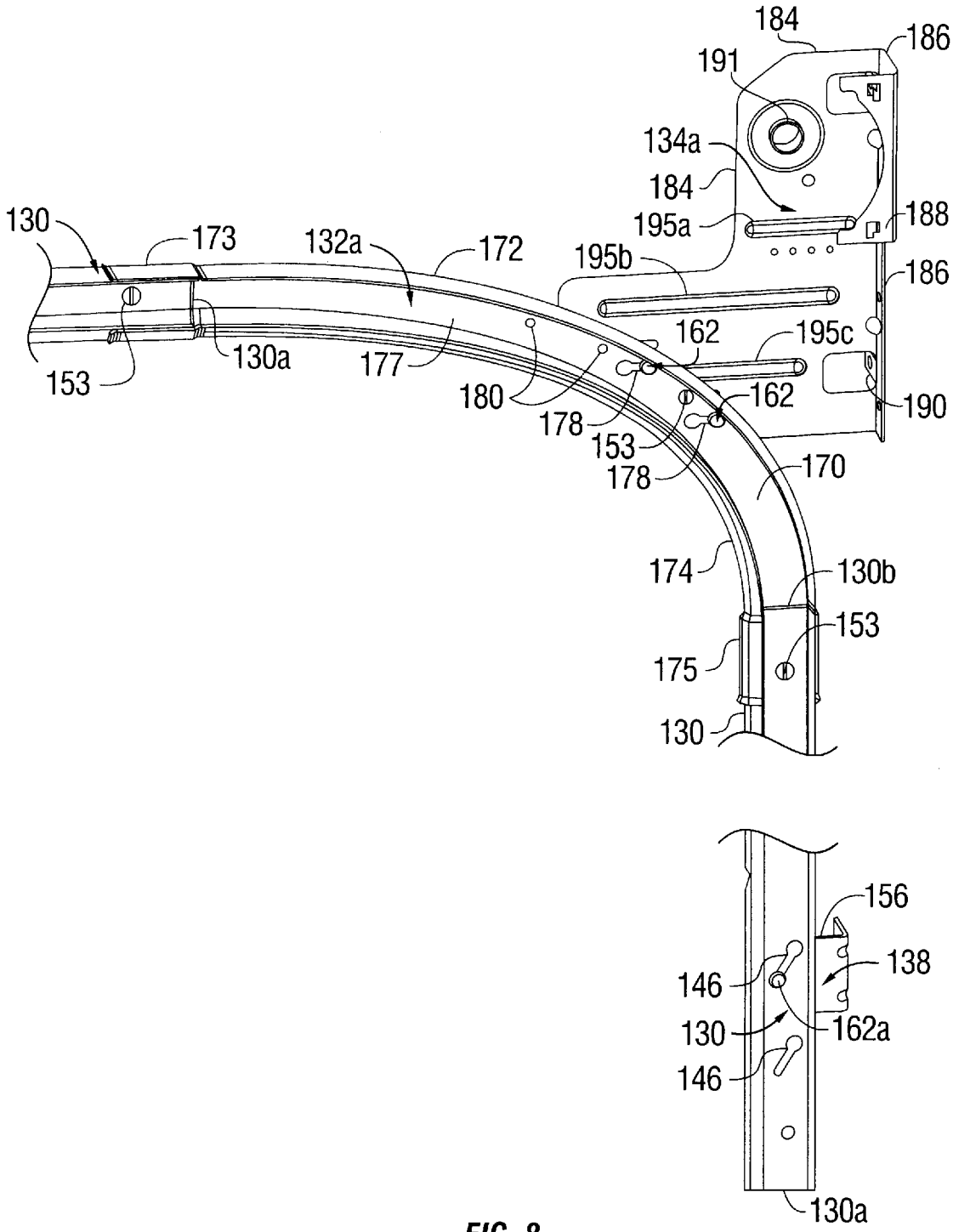
FIG. 8 is a perspective view of the track assembly shown in FIG. 2 but taken from another viewpoint.
Figure 9:
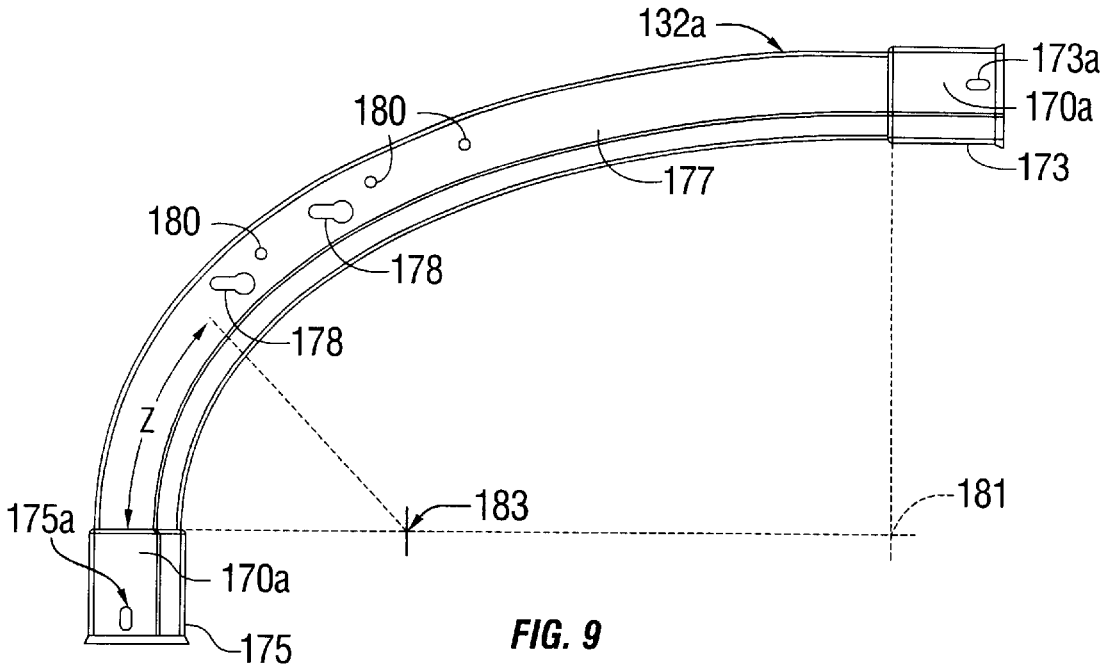
FIG. 9 is a side elevation of the curved or transition track section of the track assembly shown in FIGS. 2 and 8.

Referring now to FIGS. 8 and 9, the curvilinear track section 132*a* is preferably provided with the same cross-sectional geometry as the track sections 130 and includes a web 170 interposed a flange 172 and a channel-shaped portion 174. Opposite ends 173 and 175 of the curvilinear section 132*a* are swedged or otherwise enlarged slightly with respect to major track portion 177 to receive opposite ends 130*a* and 130*b,* respectively, of the respective horizontal and vertical track sections 130 in telescoping relationship, as shown in FIG. 8. As shown in FIG. 9, elongated fastener receiving slots 173*a* and 175*a* are provided in a web 170*a* at the respective enlarged cross section end portions 173 and 175 for receiving fastener assemblies 153, for example, as shown in FIG. 8, to positively secure track sections 130 to the track section 132*a,* if desired.

Referring further to FIGS. 8 and 9, the curvilinear track section 132*a* is also provided with plural, spaced-apart keyhole-shaped slots 178 having substantially the same geometry as the slots 146 and 148 and adapted to receive retainer members 162 supported on the header bracket 134*a,* as shown in FIG. 8. The track section 132*a* is further provided with plural spaced-apart fastener receiving holes 180, two shown in FIG. 8, one of said fastener receiving holes being interposed the slots 178, as shown in FIG. 9. In the view of FIG. 8, the fastener receiving hole 180 interposed the slots 178 is covered by a fastener assembly 153.

Referring to FIG. 9, the proportions of the curvature of the track section 132*a* are such that center point 181 of the elliptical radius of curvature defines the intersection of major and minor axes having a length ratio of about 1.5:1 to 2:1. However, the elliptical radius of curvature may not extend entirely between the enlarged cross sections provided at each end 173 and 175. For example, a second center 183 may define a circular radius of curvature beginning at the juncture of the swedged end 175 with the major portion 177 of the track section 132 and which extends from the swedged end 175 through an angle Z of about forty degrees to sixty degrees, for example. The remaining curvilinear extent of the track section 132*a* follows the elliptical radius of curvature previously discussed. The circular radius of curvature may, preferably, be about twenty percent to twenty-five percent of the major axis for the elliptical curvature part of track section 132*a*.

Figure 10:
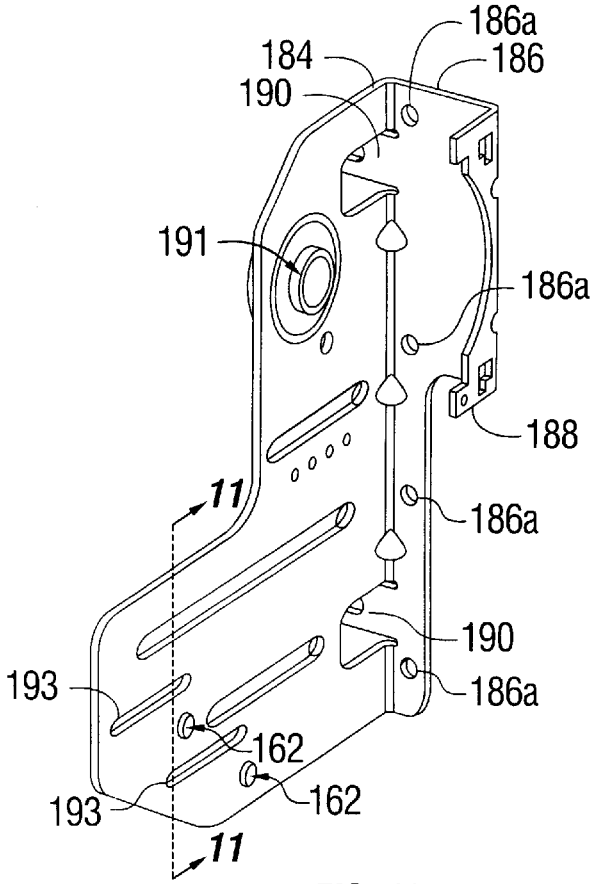
FIG. 10 is a perspective view of a header bracket which is also shown in FIGS. 2 and 8.
Figure 11:
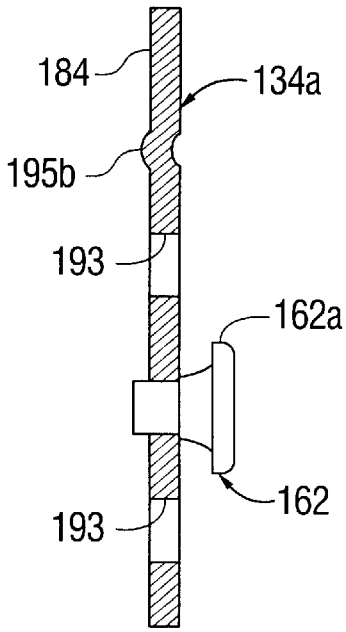
FIG. 11 is a detail section view taken along the line 11—11 of FIG. 10.

Referring further to FIGS. 8, 10 and 11, the header bracket 134*a* is illustrated in some detail as being characterized by a generally L-shaped planar flange part or plate section 184 integrally joined to a web 186 which is also integrally joined to a counterbalance mechanism mounting flange 188 extending parallel to the flange part or section 184. Spaced-apart mounting tabs 190, FIG. 10, are formed by a punching operation on the planar section 184 and by bending the planar section or bending the tabs to be coplanar with the web 186. A suitable bearing assembly 191 is shown mounted on the section 184 for supporting a counterbalance mechanism drive shaft, not shown.

Header bracket 134*a* further includes two spaced-apart retainer members 162 having the same configuration as the retainer members 162 mounted on the jamb brackets 138, respectively, and adapted to fit within the slots 178 of the curvilinear track section 132*a,* as shown in FIG. 8, for supporting the curvilinear track section with respect to the header bracket 134*a*. Spaced-apart, elongated, parallel fastener receiving slots 193 are disposed on opposite sides of one of the retainers 162, as shown in FIG. 10 for receiving one or more fastener assemblies 153. In the arrangement shown in FIG. 8, a fastener assembly 153 extends through an opening 180 in track section 132*a* and through the slot 193 which is interposed the two retainer members 162. Elongated, parallel reinforcing ribs 195*a,* 195*b* and 195*c* may be formed in the bracket section 184, as shown.

Accordingly, the curvilinear track sections 132*a* and 132*b* may be conveniently mounted on the header brackets 134*a* and 134*b* by engaging the retainer members 162 of the header brackets with the track sections within the slots 178 and adjusting the position of each curvilinear track section with respect to the web 186 of each bracket, as needed, before tightening a fastener assembly 153 in the lower slot 193. Although the fastener assembly 153 may not be required to support the track section 132*a* on the bracket 134*a,* once the proper positions of the track sections 130 are obtained, as well as the proper position of the track section 132*a,* a fastener assembly 153 may be tightened to firmly secure the track section 132*a* to a header bracket 138. A second fastener assembly, not shown, may be inserted through the fastener receiving hole or opening 180 directly adjacent the slot 178 whereby said second fastener assembly may pass through one of the slots 193, if desired.

The brackets 134*a* and 134*b* may be mounted on the wall 126 prior to assembly of the track assemblies 128*a* and 128*b* to the wall and to the respective header brackets. Alternatively, the track sections 132*a* and 132*b* may be mounted on their respective header brackets 134*a* and 134*b* by moving the retainer members 162 into the slots 178 so that the header brackets are at least loosely connected to the track sections 132*a* and 132*b* while the precise positioning of the track assemblies 128*a* and 128*b* is carried out. The brackets 134*a* and 134*b* may then be firmly secured to the wall 126 with conventional fasteners projecting through fastener receiving openings 186*a*, FIG. 10, and through suitable openings in the tabs 190 of the respective header brackets. Moreover, for applications involving relatively heavy doors the horizontal track sections of track assemblies 128*a* and 128*b* may be reinforced by providing elongated angle cross section braces, not shown, extending from and secured to the header brackets 134*a* and 134*b* and secured to the horizontal track sections 130, respectively.

Thanks to the elongated slots 178 and the cooperating retainer members 162 on the header brackets 134*a* and 134*b,* as well as the angled slots 146 and 148 on the track sections 130, which cooperate with the jamb brackets 138, the track assemblies 128*a* and 128*b* may be quickly and accurately installed at the point of installation of a sectional door, such as the door 122.

The construction and installation of the track assemblies 128*a* and 128*b* is believed to be within the purview of one skilled in the art of upward acting door guide track assemblies based on the foregoing description. Materials used in fabricating the track assemblies 128*a* and 128*b* may be conventional engineering materials used for upward acting door guide track assemblies including, for example, 0.085 inch thick steel plate for the bracket members and 0.068 inch thick steel plate for the track members, respectively. Other materials may be considered for fabricating each of the component parts of the track assemblies 128*a* and 128*b*.

Although a preferred embodiment of the invention has been described in detail hereinabove, those skilled in the art will also recognize that various substitutions and modifications may be made without departing from the scope and spirit of the appended claims.

What is claimed is:

1. A guide track assembly for guiding movement of an upward acting door between open and closed positions, said guide track assembly including:

a first substantially linear track section adapted to be mounted extending substantially horizontally;

a second substantially linear track section adapted to be mounted extending substantially vertically adjacent a wall;

a header bracket for mounting on said wall;

a curvilinear track section extending between said first and second linear track sections, said curvilinear track section being engaged with and releasably connected directly at its opposite ends in supportive relationship to said linear track sections, respectively, and said curvilinear track section being connected directly to said header bracket at a point between opposite ends of said curvilinear track section; and plural jamb brackets adapted to be connected to said wall and to said second track section by cooperating retainers and elongated slots formed on said jamb brackets and said second track section in such a way as to provide for supporting said second track section with respect to said wall and for adjusting the position of said track assembly with respect to said wall.

2. The guide track assembly set forth in claim 1 wherein:

said slots are formed spaced apart in said second track section extending at an acute angle with respect to the longitudinal extent of said second track section.

3. The track assembly set forth in claim 2 wherein:

said second track section includes a first slot at one end of said second track section, a second slot at an opposite end of said second track section and at least one slot intermediate said first and second slots.

4. The track assembly set forth in claim 3 wherein:

said first and second slots extend at said acute angles in different directions with respect to each other.

5. The track assembly set forth in claim 4 including:

spaced-apart fastener receiving openings formed in said second track section adjacent opposite ends thereof, respectively.

6. The track assembly set forth in claim 1 wherein:

said first track section and said second track section are identical.

7. The track assembly set forth in claim 1 wherein:

said curvilinear track section is formed to have a substantially elliptical radius of curvature.

8. The track assembly set forth in claim 1 wherein:

said curvilinear track section includes opposed enlarged end portions for receiving ends of said first and second track sections, respectively, therewithin for supporting said first and second track sections with respect to said curvilinear track section.

9. The track assembly set forth in claim 1 wherein:

said jamb brackets include opposed flanges, a retainer member disposed on one of said flanges and engageable with said second track section at an elongated slot formed in said second track section and a fastener receiving opening formed on the other of said flanges.

10. The track assembly set forth in claim 9 including:

a projection on said one flange for cooperating with said retainer member to snugly retain said jamb bracket connected to said second track section when said retainer member is disposed in said slot.

11. The track assembly set forth in claim 1 wherein:

said header bracket includes a web for mounting said header bracket on said wall adjacent said guide track assembly, an integral flange part extending substantially normal to said web and at least one retainer member mounted on said flange part of said header bracket for connecting said curvilinear track section to said header bracket.

12. The track assembly set forth in claim 11 including:

at least one slot formed in said flange part of said header bracket for receiving a fastener assembly for securing said curvilinear track section to said header bracket.

13. Opposed guide track assemblies for supporting an upward acting door for movement between door open and closed positions, said guide track assemblies each including:

a first substantially linear track section adapted to extend substantially horizontally;

a second substantially linear track section adapted to extend substantially vertically adjacent a wall;

a header bracket adapted to be secured to said wall;

a curvilinear track section extending between said first and second linear track sections and operable to be engaged with and releasably connected directly to said linear track sections in supportive relationship, respectively, and said curvilinear track section is operable to be connected directly to said header bracket; and plural jamb brackets adapted to be secured to said wall and to said second track section by a retainer disposed on said jamb brackets, respectively, said retainer being adapted to be disposed in elongated slots formed in said second track section for securing said track assembly with respect to said wall and for adjusting the position of said track assembly with respect to said wall.

14. The invention set forth in claim 13 wherein:

said linear track sections are interchangeable.

15. The invention set forth in claim 13 wherein:

each of said curvilinear track sections includes at least one elongated slot formed therein and each of said header brackets includes a retainer mounted thereon and operable to be disposed in said one slot for supporting said curvilinear track section adjustably on and with respect to said header bracket.

16. The invention set forth in claim 15 wherein:

each of said header brackets includes at least one elongated slot formed adjacent said retainer for receiving a fastener assembly for securing said curvilinear track section firmly to said header bracket.

17. The invention set forth in claim 15 wherein:

said slots are formed extending at an acute angle with respect to the longitudinal extent of said second track section.

18. The invention set forth in claim 13 wherein:

said linear track sections are connected to said curvilinear track section at respective ones of enlarged end portions of said curvilinear track sections which receive said first and second linear track sections telescopically therein, respectively.

19. A guide track assembly for guiding movement of an upward acting door between open and closed positions, said guide track assembly including:

a first substantially linear track section adapted to be mounted extending substantially horizontally;

a second substantially linear track section adapted to be mounted extending substantially vertically adjacent a wall;

said first and second track sections being interchangeable;

a header bracket for mounting on said wall;

a curvilinear track section extending between said first and second linear track sections, said curvilinear track section including opposite end portions for receiving respective ends of said first and second linear track sections, respectively, whereby said curvilinear track section is adapted to be engaged with and releasably connected directly to said linear track sections in supportive relationship, respectively, and said curvilinear track section is adapted to be releasably connected to said header bracket; and plural jamb brackets adapted to be connected to said wall and to one of said linear track sections for supporting said one linear track section with respect to said wall.

20. A guide track assembly for guiding movement of an upward acting door between open and closed positions, said guide track assembly including:

a first substantially linear track section adapted to be mounted extending substantially horizontally;

a second substantially linear track section adapted to be mounted extending substantially vertically adjacent a wall;

a header bracket for mounting on said wall;

a curvilinear track section extending between said first and second linear track sections and releasably connected directly to said linear track sections, respectively, said curvilinear track section being engaged with and releasably connected directly to said header bracket at a point between opposite ends of said curvilinear track section, said curvilinear track section includes plural spaced apart elongated slots formed therein;

plural jamb brackets adapted to be connected to said wall and to said second track section, respectively; and said header bracket includes a first part for mounting said header bracket on said wall and a second part projecting substantially normal to said first part and including a retainer mounted thereon and disposed in one of said slots for supporting said curvilinear track section adjustably on and with respect to said header bracket.

21. The track assembly set forth in claim 20 wherein:

said header bracket includes at least one elongated slot formed adjacent said retainer for receiving a fastener assembly for securing said curvilinear track section firmly to said header bracket.

* * * * *